US005085234A

United States Patent [19]

Silverman

[11] Patent Number: 5,085,234

[45] Date of Patent: Feb. 4, 1992

[54] FINGERNAIL SHIELDING METHOD

[76] Inventor: Gloria Silverman, 7491 NE. Federal Hwy. C-5 #186, Boca Raton, Fla. 33487

[21] Appl. No.: 633,218

[22] Filed: Dec. 14, 1990

[51] Int. Cl.[5] ..... A45D 29/00

[52] U.S. Cl. ..... 132/73; 132/285; 2/21

[58] Field of Search ..... 132/73, 285, 319, 333; 2/21

[56] References Cited

U.S. PATENT DOCUMENTS

| | | | |
|---|---|---|---|
| 2,179,046 | 11/1939 | Lewis | 132/73 |
| 2,251,551 | 8/1941 | O'Reilly | 2/21 |
| 2,297,807 | 10/1942 | Sommers | 2/21 |
| 2,323,854 | 7/1943 | Silverman | 2/21 |
| 2,546,619 | 3/1951 | Turner | 2/21 |
| 2,557,759 | 6/1951 | Pfister | 132/285 |
| 3,972,325 | 8/1976 | Bluestone | 128/132 |
| 4,089,066 | 5/1978 | Dethman | 2/21 |
| 4,694,843 | 9/1987 | Casenhiser | 2/21 |
| 4,966,174 | 10/1990 | Stanczak | 132/73 |
| 4,972,857 | 11/1990 | Stewart et al. | 132/73 |

*Primary Examiner*—John J. Wilson
*Assistant Examiner*—Frank A. LaViola
*Attorney, Agent, or Firm*—Oltman and Flynn

[57] ABSTRACT

A fingernail shield includes a tube having a diameter larger than that of a typical human finger and an adhesive within the tube for securing the tube to a finger. The fingernail shield preferably has an octagonal cross-section and is tapered to form a frustum shape. The tube may have a notch at one end for locating the adhesive, and is preferably made of a transparent, colored plastic. A method of protecting drying polish on the nail of a finger using this shield, includes the steps of placing the shield around a finger over the nail, orienting the shield so that the adhesive is adjacent to the side of the finger opposite the nail, pressing the side of the finger opposite the nail against the adhesive to secure the shield to the finger, leaving the shield secured to the finger until the polish hardens, and pulling the finger out of the adhesive and withdrawing it from the shield.

3 Claims, 2 Drawing Sheets

FINGERNAIL SHIELDING METHOD

BACKGROUND OF THE INVENTION

1. Field of the Invention

The present invention relates generally to the field of fingernail polish protectors, and more specifically to an octagonal tube having two-way tape along one of its interior surfaces for receiving and adhering to the end joint of a finger.

2. Description of the Prior Art

There have long been fingernail guards and protectors which fasten to fingers to shield freshly-polished nails while they dry. Drying can take hours, the guard should be both secure and comfortable to wear. Prior guards generally take the form of a curved plate projecting over the nail from an anchoring member. The anchoring member is typically either a ring or a clip which grips the finger behind the nail area.

An example of the former is Dethman, U.S. Pat. No. 4,089,066, issued on May 16, 1978. Dethman teaches an anchoring ring formed of two straps which wrap around a finger and fasten together. A stem portion joins the straps to a cylindrical shield which surrounds the end joint of the finger. The cylindrical shield has axial cuts at either side of the nail, one such cut being hinged, so that it can open to expose the nail for polishing. A problem with Dethman is that it is complex and thus relatively prone to mechanical failure and high cost. Another problem is that the Dethman shield and stem portion can pivot on the finger and make contact with the polished nail.

Another variation is disclosed in Pfister, U.S. Pat. No. 2,557,759, issued on June 19, 1951. Pfister discloses a complex cylindrical sleeve arrangement having numerous ventilating holes, a cap for its open end, and a port contoured to the shape of the nail to apply polish through. Once again, there are problems of potential failure of its several parts, high cost and effort to use it correctly.

Then there is Turner, U.S. Pat. No. 2,546,619, issued on Mar. 27, 1951. Turner teaches a spring clip and a nail shield which pivots up from the nail surface for polishing, and down parallel to the nail surface for protection. The spring clip has resilient ears which grip the end of the finger behind the nail area. The Turner spring clips would likely cause discomfort, particularly if made of metal, and may restrict blood circulation. Yet if the clips were made loose to minimize discomfort, they might rotate on the finger, bringing the shield into contact with the wet polish. Turner is also complex, and therefore costly and prone to failure.

Silverman, U.S. Pat. No. 2,323,854, issued on July 6, 1943, is essentially like Turner except that the shield does not pivot. A spring clip much like an automobile hose clamp is joined to a shovel-shaped shield projecting axially over the nail. While less complex than those above, this device must either grip tightly and cause discomfort, or be loose and potentially able to slip and touch the wet polish. Furthermore, one cannot polish with the device in place, and sliding the device over the end of a finger after polishing may cause smearing.

Sommers, U.S. Pat. No. 2,297,807, issued on Oct. 6, 1942, is a variation of the Silverman design. Sommers differs from Silverman in that the clip has operating levers to open the clip for inserting a finger. This feature eliminates the need to slide the device over the end of the finger. Also, ventilating holes are provided in the shield to enhance air circulation over the drying polish. This variation is, however, uncomfortable and prone to slip and touch the wet polish.

O'Reilly, U.S. Pat. No. 2,251,551, issued on Aug. 5, 1941, teaches a capsule which surrounds the end joint of a finger. The capsule is essentially test-tube shaped, formed of two axially divided capsule halves hinged on one side for finger insertion. An elastic band holds the capsule closed. The portion of the capsule over the nail bulges outward and is perforated to provide air circulation over the nail. Yet O'Reilly is complex and expensive, and is capable of rotating on the finger to bring the capsule wall into contact with the wet polish.

Lewis, U.S. Pat. No. 2,179,046, issued on Nov. 7, 1939, teaches a shield in the form of a protective, resilient metal strap which wraps around the tip of a finger. The ends of the strap press against the top and bottom of the finger. The strap has perforations to enhance ventilation. Yet, again, Lewis is relatively uncomfortable, complex, expensive, and awkward to use. One can smear the wet polish while trying to engage the strap on the finger.

Finally, Bluestone, U.S. Pat. No. 3,972,325, issued on Aug. 3, 1976, teaches a nail brace to prevent a nail from breaking. An adhesive member is pressed against and bonds to the underside of the nail. Although Bluestone is simple and convenient to use, it is not intended to and cannot protect drying polish from contact and smearing.

It is thus an object of the present invention to provide a fingernail shield which is comfortable and will not slide and touch the wet nail polish.

It is another object of the present invention to provide such a fingernail shield which is simple in construction and therefore not prone to failure.

It is finally an object of the present invention to provide such a nail shield which is inexpensive and easy to use.

SUMMARY OF THE INVENTION

The present invention accomplishes the above-stated objectives, as well as others, as may be determined by a fair reading and interpretation of the entire specification.

A fingernail shield is provided including a tube having a diameter larger than that of the end joint of a typical finger and an adhesive within the tube for securing the tube to a finger. The fingernail shield preferably has an octagonal cross-section. The tube is preferably tapered to form a frustum shape, and therefore has a large end and a small end. The tube may have a notch formed at one end for ready location of the adhesive. The tube is preferably made of a transparent, colored plastic. The adhesive may be provided by two-way tape.

A method of protecting drying polish on the nail of a finger is also provided, using a shield in the form of a tube having an inner surface coated with an adhesive, including the steps of: placing the shield around the finger and over the nail without touching the nail, orienting the shield so that the adhesive is adjacent to the side of the finger opposite the nail, pressing the side of the finger opposite the nail against the adhesive to secure the shield to the finger, leaving the shield secured to the finger until the polish hardens, pulling the finger out of the adhesive and withdrawing the finger from the shield. The method may additionally include the step of locating the adhesive by finding a notch on one end of the shield, to help in orienting the shield.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
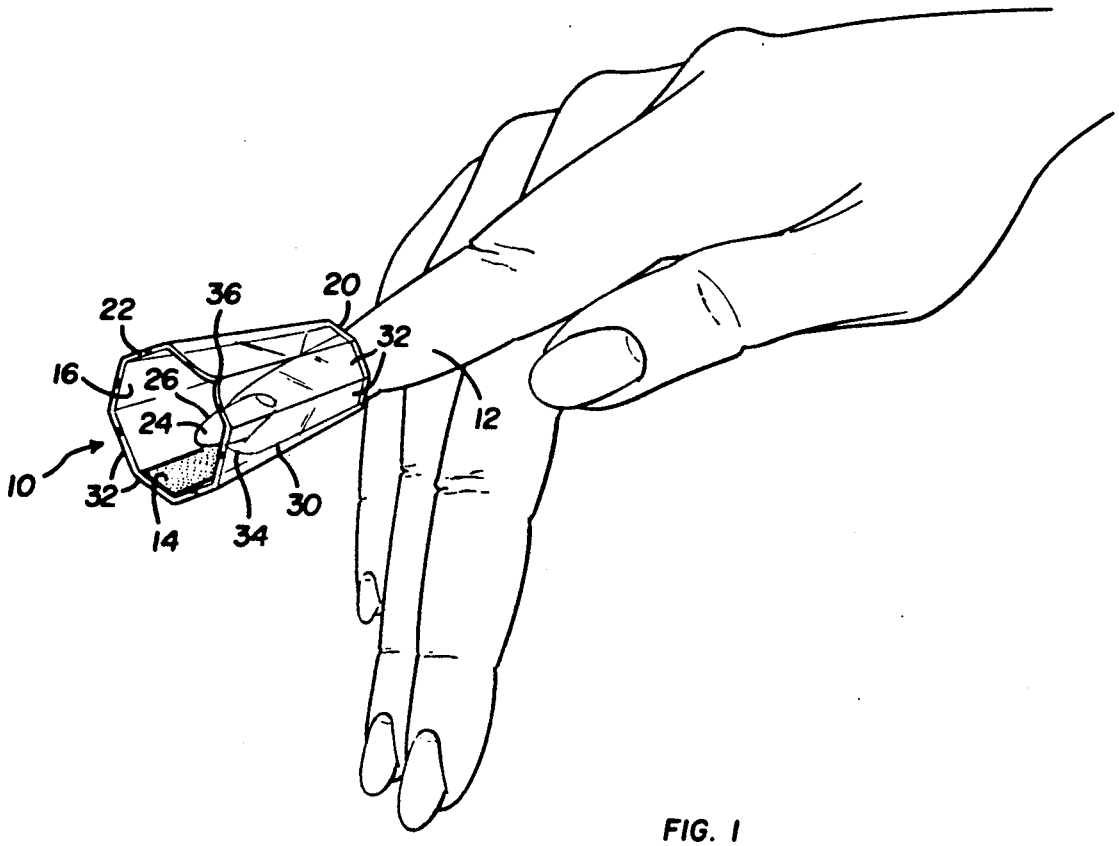
FIG. 1 is a perspective view of the inventive fingernail shield positioned for use on a finger.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

THE PREFERRED EMBODIMENT

Referring to FIG. 1, a fingernail shield 10 is disclosed having an essentially tubular shape, for placing over the end of a finger 12. Shield 10 preferably has a diameter one-eighth to one-half inch larger than that of the end joint of a typical finger 12, and a length of about one inch. An adhesive 14 is spread on the inner surface 16 of shield 10, and preferably extends axially along inner surface 16 from one end 20 to the other end 22. Adhesive 14 may be provided by a strip of tape having an adhesive on both sides, hereinafter referred to as two-way tape.

After polish 24 is applied to a nail 26, shield 10 is positioned around the end joint of the finger 12 so that adhesive 14 is adjacent to the finger underside 30 of finger 12. Shield 10 should completely surround but not come into contact with nail 26. Finger underside 30 is then pressed against adhesive 14 to form a secure bond. The diameter of shield 10 must be sufficiently large to permit air to enter, circulate over nail 26 and exit, to dry polish 24. At the same time, the diameter of shield 10 must be small enough to prevent nail 26 contact with outside objects. When polish 24 dries, finger underside 30 is gently pulled off adhesive 14 and finger 12 is withdrawn from shield 10.

Figure 2:
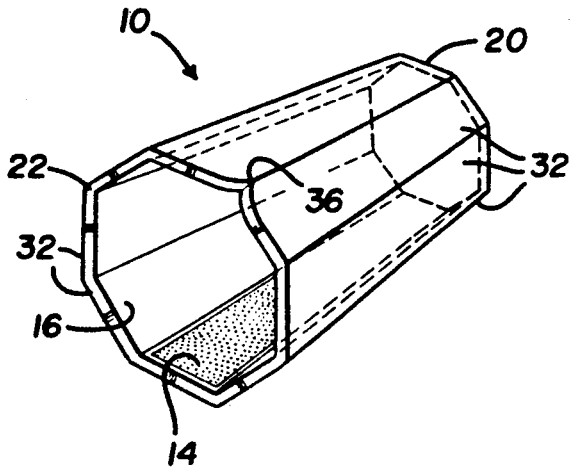
FIG. 2 is a perspective view of the inventive fingernail shield alone.

The preferred cross-sectional shape of shield 10 is octagonal. See FIG. 2. Shield 10 thus comprises eight faces or panels 32, and adhesive 14 is placed along the inner surface of one panel 32. A multi-sided cross-section is preferred over a circular one because it provides a defined area for retaining adhesive 14. It also provides a planar rather than concave surface for improved adhesive 14 contact with finger 12.

Among multi-sided cross-sections, the octagonal shape is preferred because of its symmetry, strength and panel 32 width. Finger 12 rests flat against one panel 32, while adjacent panels 32 rise and diverge on either side of finger 12. Fewer panels 32 than eight would mean smaller angles between adjacent panels 32, which would make shield 10 more susceptible to collapse. More panels 32 than eight, for the same given diameter, would make the panels 32 too narrow to comfortably receive finger underside 30.

Figure 3:
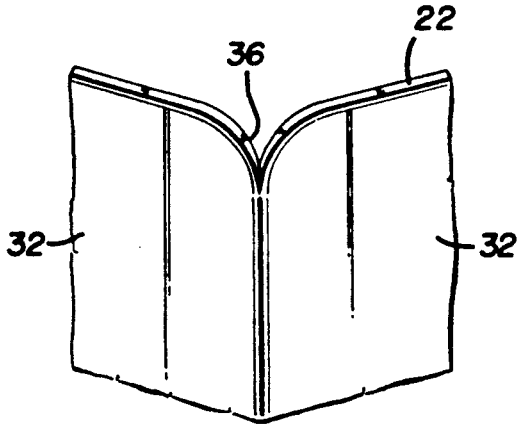
FIG. 3 is a close-up view of the notch in an end of the shield.

Shield 10 optionally tapers axially, thus taking the shape of a cone with its top cut off, also known as a frustum shape. The small end 20 of shield 10 has a diameter about one eighth inch larger than the end joint of a typical finger 12, and the large end 22 preferably has a diameter about three eighths inch larger than the end joint of a typical finger 12. To permit the user to quickly identify large end 22 and panel 32 having adhesive 14, a notch 36 is provided in the edge of large end 22. See FIG. 3. Notch 36 is formed at the intersection of two panels 32 opposite the panel 32 having adhesive 14. For aesthetic appeal, notch 36 is preferably V-shaped, with either side of the V arcing inwardly. In this way, notch 36 suggests the upper, middle portion of the popular image of a heart.

Shield 10 may be formed from virtually any solid material capable of retaining its shape, such as most plastics or metals. The preferred material is a resilient, transparent, colored or tinted plastic. The coloring, typically red, is light enough to permit inspection of drying polish 24 through shield 10. At the same time, the coloring provides a feminine, aesthetically pleasing appearance.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of protecting drying polish on the nail of a finger, using a shield in the form of a tube having a cross-section formed of a plurality of essentially flat sides, and having an inner surface coated with an adhesive, the adhesive being a strip of tape having adhesive on both sides, comprising the steps of:

securing the strip of tape on the inside of the tube along one of the plurality of essentially flat sides, placing the shield around the finger and over the nail, without touching the nail, orienting the shield so that the adhesive is adjacent to the side of the finger opposite the nail, pressing the side of the finger opposite the nail against the adhesive to secure the shield to the finger, leaving the shield secured to the finger until the polish hardens, pulling the finger out of the adhesive and withdrawing the finger from the shield.

2. A method as in claim 1, wherein said shield has a notch at the one end, additionally comprising the step of:

locating the adhesive by finding the notch, to help in orienting the shield.

3. A method as in claim 2, wherein said shield has a large end and a small end, additionally comprising the step of:

locating the large end by finding the notch, to help in orienting the shield.

* * * * *